US008231064B2

(12) United States Patent
Lum et al.

(10) Patent No.: US 8,231,064 B2
(45) Date of Patent: Jul. 31, 2012

(54) WATER CONTROL FIXTURE HAVING AUXILIARY FUNCTIONS

(75) Inventors: Ken Lum, Fresno, CA (US); Dale Kempf, Manton, CA (US)

(73) Assignee: Grundfos Pumps Corporation, Olathe, KS (US)

( * ) Notice: Subject to any disclaimer, the term of this patent is extended or adjusted under 35 U.S.C. 154(b) by 1066 days.

(21) Appl. No.: 12/165,165

(22) Filed: Jun. 30, 2008

(65) Prior Publication Data

US 2009/0007975 A1 Jan. 8, 2009

Related U.S. Application Data

(60) Provisional application No. 60/958,145, filed on Jul. 2, 2007.

(51) Int. Cl.
*G05D 23/12* (2006.01)

(52) U.S. Cl. ..... 236/12.13; 137/337

(58) Field of Classification Search ..... 236/12.1, 236/12.11, 12.13; 137/337
See application file for complete search history.

(56) References Cited

U.S. PATENT DOCUMENTS

| | | | |
|---|---|---|---|
| 2,507,954 A | 5/1950 | Binnall | |
| 2,716,424 A | 8/1955 | Watts | |
| 2,823,695 A | 5/1958 | Kool | |
| 2,842,155 A | 7/1958 | Peters | |
| 3,232,336 A | 2/1966 | Leslie | |
| 3,543,836 A | 12/1970 | Paulson | |
| 3,741,195 A | 6/1973 | Ellis | |
| 3,989,058 A | 11/1976 | Jackson | |
| 4,068,800 A | 1/1978 | Doherty, Jr. | |
| 4,142,515 A | 3/1979 | Skaats | |
| 4,311,272 A | 1/1982 | Föller | |
| 4,321,943 A | 3/1982 | Haws | |
| 4,331,292 A | 5/1982 | Zimmer | |
| 4,606,325 A | 8/1986 | Lujan, Jr. | |
| 4,682,728 A * | 7/1987 | Oudenhoven et al. | 236/12.12 |

(Continued)

FOREIGN PATENT DOCUMENTS

DE 297 18 257 U 1 7/1998

(Continued)

OTHER PUBLICATIONS

NIBCO.com, Just Right, Hot Water in Seconds!, 10 pages, 2004.

(Continued)

*Primary Examiner* — Marc Norman
(74) *Attorney, Agent, or Firm* — The Small Patent Law Group, LLP; Dean Small

(57) ABSTRACT

A water control fixture includes a housing having a plurality of ports defining a hot water inlet port, a cold water port, a fixture outlet port, and an auxiliary port, wherein water is dispensed from the housing via the fixture outlet port. A flow control unit is configured to be selectively positioned in fluid communication with different combinations of the plurality of ports, wherein the flow control unit has a main passage in fluid communication with the hot water inlet port, the cold water port, and the fixture outlet port. The flow control unit controls the flow of water from the hot water inlet port and the cold water port to the fixture outlet port. The flow control unit has an auxiliary passage in fluid communication with the auxiliary port and at least one of the hot water inlet port, the cold water port, and the fixture outlet port to perform an auxiliary function.

19 Claims, 6 Drawing Sheets

U.S. PATENT DOCUMENTS

| | | | | |
|---|---|---|---|---|
| 4,896,658 | A | 1/1990 | Yonekubo | |
| 4,917,294 | A | 4/1990 | Bergmann et al. | |
| 4,930,551 | A | 6/1990 | Haws | |
| 5,119,988 | A | 6/1992 | Fiedrich | |
| 5,135,021 | A | 8/1992 | Pegg | |
| 5,183,029 | A | 2/1993 | Ranger | |
| 5,205,318 | A | 4/1993 | Massaro | |
| 5,209,401 | A | 5/1993 | Fiedrich | |
| 5,261,443 | A | 11/1993 | Walsh | |
| 5,263,643 | A | 11/1993 | Wells et al. | |
| 5,287,570 | A | 2/1994 | Peterson | |
| 5,323,803 | A | 6/1994 | Blumenauer | |
| 5,350,112 | A * | 9/1994 | Stein | 236/12.13 |
| 5,503,183 | A | 4/1996 | Fenn | |
| 5,572,985 | A | 11/1996 | Benham | |
| 5,606,987 | A | 3/1997 | Weber | |
| 5,623,990 | A | 4/1997 | Pirkle | |
| 5,791,557 | A | 8/1998 | Kunze | |
| 5,819,785 | A | 10/1998 | Bardini | |
| 5,829,467 | A | 11/1998 | Spicher | |
| 5,873,518 | A | 2/1999 | Richmond | |
| 6,050,285 | A * | 4/2000 | Goncze et al. | 137/98 |
| 6,257,493 | B1 | 7/2001 | Chamot et al. | |
| 6,286,464 | B1 | 9/2001 | Abraham | |
| 6,929,187 | B2 | 8/2005 | Kempf | |
| 7,104,461 | B2 | 9/2006 | Restivo, Sr. et al. | |
| 2008/0061155 | A1 * | 3/2008 | Seymour | 236/12.11 |

FOREIGN PATENT DOCUMENTS

| | | |
|---|---|---|
| DE | 197 12 051 | 9/1998 |
| EP | 1 018 063 B1 | 5/2004 |
| WO | WO 98/43143 | 10/1998 |

OTHER PUBLICATIONS

The Chilipepper Hot Water Appliance, How to Get FASTER Hot Water!!!, 22 pages, 2004.

Installation and Operating Instructions for the Chilipepper Appliance, 2 pages, 2004.

Metlund Systems, 1999, Total 1 pg. Advance Conservation Technology.

The Blumenauer Corporation Aqualink, Why Wait for HOT Water?; Apr. 19, 2001; 4 pages, 2004.

The Blumenauer Corporation Aqualink, How it Works; Apr. 19, 2001; 2 pages, 2004.

The Blumenauer Corporation, Aqua-Heat Hot Water recirculating System; 4 pages, 2004.

Metlund (S-46, S01, and S02) PreFab Systems; S-Series HOT Water D'Mand Systems For Standard Piping(non-recirc) Installation and Operating Instructions; 7 pg, 2004.

Metlund D'Mand Systems; Got Hot Water? 2 pages, 2004.

Jim Dulley, Update Bulletin No. 991, 2001, 4 pages, 2004.

Metlund Systems, Advanced Conservation Tchnology, Inc. 16 pages, 2004.

Medlund Systems, Easy Installation Instructions, 10 pages, 2004.

Medlund Systems, Energy Technology Status Report—E.T.S.R., 11 pages, 2004.

Medlund Systems, Online Ordering, Purchasing Tips, 2 pages, 2004.

Grundfos Hot Water Recirulation Product and Application Guide, 10 pages, 2004.

* cited by examiner

WATER CONTROL FIXTURE HAVING AUXILIARY FUNCTIONS

CROSS-REFERENCE TO RELATED APPLICATIONS

This application claims the benefit of U.S. Provisional Application No. 60/958,145 filed Jul. 2, 2007, titled "WATER CONTROL FIXTURE HAVING AUXILIARY FUNCTIONS", the subject matter of which is expressly incorporated herein by reference in its entirety.

BACKGROUND OF THE INVENTION

The subject matter herein relates generally to water circulating systems, and more particularly, to water control fixtures having auxiliary functions.

Home and industrial water distribution systems distribute water to various fixtures, including sinks, bathtubs, showers, dishwashers and washing machines, that are located throughout the house or industrial building. The typical water distribution system brings water in from an external source, such as a city main water line or a private water well, to the internal water distribution piping system. The water from the external source is typically either at a cold or cool temperature. One segment of the piping system takes this incoming cold water and distributes it to the various cold water connections located at the fixtures where it will be used (e.g., the cold water side of the faucet at the kitchen sink). Another segment of the piping system delivers the incoming cold water to a water heater which heats the water to the desired temperature and distributes it to the various hot water connections where it will be used (e.g., the hot water side of the kitchen faucet). At the fixture, cold and hot water either flows through separate hot and cold water control valves that are independently operated to control the temperature of the water into the fixture by controlling the flow rate of water from the separate valves, or the water is mixed at a single valve that selectively controls the desired water temperature flowing from the fixture.

A problem with most home and industrial water distribution systems is that hot water is not always readily available at the hot water side of the fixture when it is desired. This problem is particularly acute in water use fixtures that are located a distance from the hot water heater or in systems with poorly insulated pipes. When the hot water side of these fixtures is left closed for some time, such as overnight, the hot water in the hot water segment of the piping system sits in the pipes and cools. As a result, the temperature of the water between the hot water heater and the fixture lowers until it becomes cold or at least tepid. When opened again, it is not at all uncommon for the hot water side of such a fixture to supply cold water through the hot water valve when it is first opened and for some time thereafter. At the sink, bathtub or shower fixture located away from the water heater, the person desiring to use the fixture will either have to use cold or tepid water instead of hot water or wait for the distribution system to supply hot water through the open hot water valve. Most users have learned that to obtain the desired hot water, the hot water valve must be opened and left open for some time so that the cool water in the hot water side of the piping system will flow out ahead of the hot water. For certain fixtures, such as virtually all dishwashers and washing machines (which are not usually provided with a bypass valve), there typically is no method of "draining" away the cold or tepid water in the hot water pipes prior to utilizing the water in the fixture.

The inability to have hot water at the hot water side of the fixture when it is desired creates a number of problems. One problem is having to utilize cold or tepid water when hot water is desired. This is a particular problem for the dishwasher and washing machine fixtures in that hot water is often desired for improved operation of those appliances. Certain dirty dishes and clothes are much easier to clean in hot water as opposed to cold or tepid water. Even in those fixtures where the person can let the cold or tepid water flow out of the fixture until it reaches the desired warm or hot temperature, there are certain problems associated with such a solution. One such problem is the waste of water that flows out of the fixture through the drain and, typically, to the sewage system. This good and clean water is wasted (resulting in unnecessary water treatment after flowing through the sewage system). Water waste is compounded when the person is inattentive and hot water begins flowing down the drain and to the sewage system. Yet another problem associated with the inability to have hot water at the hot water valve when needed is the waste of time for the person who must wait for the water to reach the desired temperature.

The use of bypass valves and/or water recirculation systems in home or industrial water distribution systems to overcome the problems described above have been known for some time. However, these water recirculation systems have problems and limitations. For example, these water recirculation systems are typically operated by a pump and the pump must be operated for a certain cycle time to dispel all of the cooled water from the hot water pipe system before hot water is available at the fixture. Problems arise when hot water is desired at the fixture before the end of a cycle, or when the pump is not running. However, constantly running the pump so that hot water is always available is not economical. Accordingly, the above mentioned problems (e.g. waste of water) are still prevalent in water recirculation systems today.

An additional problem with known bypass valves is that the bypass valve is typically a separate component that is plumbed into the water delivery system of the fixture. As such, an additional connection must be made to install the bypass valve into the system. Additionally, the bypass valve may take up space at the fixture location and may take time to install. Moreover, the additional connections provide potential areas for leaking, which may cause damage to the home or fixture.

Another problem with known bypass valves is that the bypass valves are designed to be installed into a particular type of recirculation system. However, there are multiple types of systems available within homes today. For example, some recirculation systems permit recirculation flow through the cold water supply pipes back to the water heater. Other recirculation systems permit recirculation flow through a dedicated hot water return pipe back to the water heater. Bypass valves having different designs are required to attach to one system or the other system.

BRIEF DESCRIPTION OF THE INVENTION

In one embodiment, a water control fixture includes a housing having a plurality of ports defining a hot water inlet port, a cold water port, a fixture outlet port, and an auxiliary port, wherein water is dispensed from the housing via the fixture outlet port. A flow control unit is configured to be selectively positioned in fluid communication with different combinations of the plurality of ports, wherein the flow control unit has a main passage in fluid communication with the hot water inlet port, the cold water port, and the fixture outlet port. The flow control unit controls the flow of water from the hot water inlet port and the cold water port to the fixture outlet port. The flow control unit has an auxiliary passage in fluid communication with the auxiliary port and at least one of the hot water inlet port, the cold water port, and the fixture outlet port to perform an auxiliary function.

Optionally, the auxiliary port may define a dedicated return port configured to be in fluid communication with a dedicated hot water return line, wherein the auxiliary passage of the flow control unit includes a bypass passage in fluid communication with the dedicated return port and the hot water inlet port, and wherein the flow control unit permits recirculating flow through the bypass passage. The water control fixture may include an antiscald device in fluid communication with the auxiliary port, wherein the antiscald device shuts off flow from the fixture outlet port when the water pressure is above a predetermined amount. The antiscald device may change the flow from one of the hot water inlet port, the cold water port and the auxiliary port to change the mixture of the water dispensed from the fixture outlet port when the water temperature is above a predetermined amount. Optionally, the water control fixture includes a pressure balance device in fluid communication with the auxiliary port, wherein the pressure balance device changes a mixture ratio of water from at least one of the hot water inlet port, the cold water inlet port and the auxiliary port when a pressure of the water flowing through at least one of the hot water inlet port, the cold water port and the auxiliary port fluctuates.

In another embodiment, a water control fixture is provided that includes a housing having at least four ports and a flow control unit operatively associated with the housing and the at least four ports. The flow control unit fluidly couples the at least four ports in multiple combinations of ports to perform different functions, wherein a first set of the ports is fluidly coupled to perform a first function and a second set of the ports is fluidly coupled to perform a second function.

In a further embodiment, a water control fixture is provided including a housing having a chamber and a plurality of ports in fluid communication with the chamber. The plurality of ports define a hot water inlet port, a bypass port, and a fixture outlet port, wherein water is dispensed via the fixture outlet port. A flow control unit is received within the chamber and is in fluid communication with the plurality of ports for controlling the flow of water from the hot water inlet port to the fixture outlet port and for controlling the flow of water from the hot water inlet port to the bypass port. The flow control unit opens to permit a flow of water from the hot water inlet port to the bypass port based on an activation condition. Optionally, the activation condition may be based on a pressure of the water within the flow control unit such that when the pressure is above a predetermined amount, water is permitted to flow from the hot water inlet port to the bypass port. Alternatively, the activation condition may be based on a temperature of the water within the flow control unit such that when the temperature is below a predetermined amount, water is permitted to flow from the hot water inlet port to the bypass port.

DETAILED DESCRIPTION OF THE INVENTION

Figure 1:
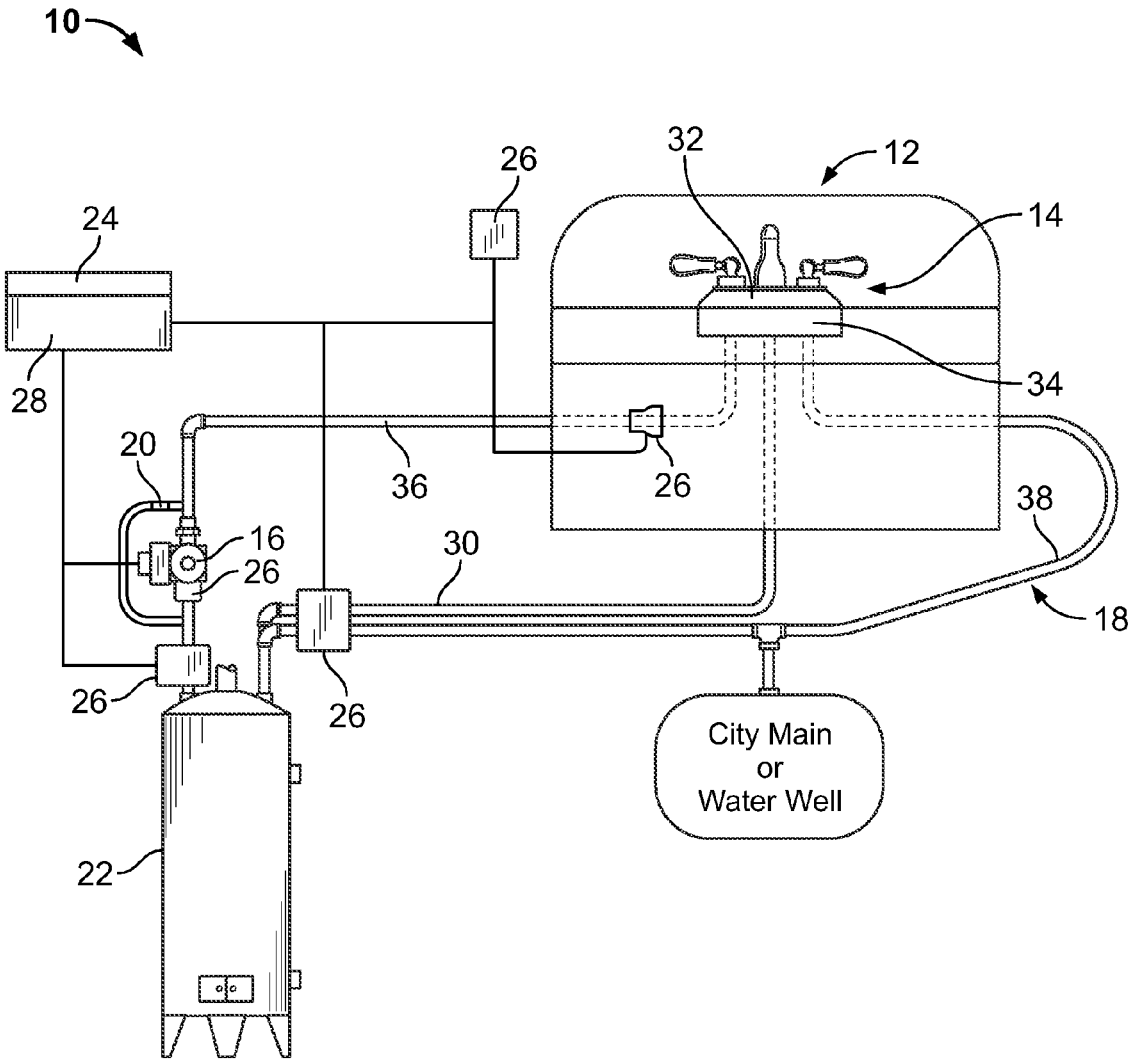
FIG. 1 illustrates a water circulation system and fixture utilizing a valve assembly in accordance with an exemplary embodiment.

FIG. 1 is a side elevation view showing a water circulation system 10 and fixture 12 utilizing a valve assembly 14 in accordance with an exemplary embodiment. In order to achieve the desired circulation flow, a single circulating pump 16 is utilized as part of a piping system 18 of the water circulating system 10. The pump 16 may be a single, small pump of the type used in residential hot water space heating. To avoid reduced flow, a check valve 20 can be plumbed in parallel with the pump 16 or incorporated within the pump housing, to pass a flow rate exceeding the pump's capacity around the pump 16. When the pump 16 is powered and flow demand is low, the check valve 20 prevents the boosted flow from re-circulating back to its own inlet.

In the illustrated embodiment, the pump 16 is located at or near a water heater 22 in the discharge piping or hot water piping. While a conventional home water heater is illustrated in FIG. 1, it is realized that other types of water heaters may be used, such as a tankless water heater. When operated, the pump 16 boosts the pressure in the hot water piping somewhat above that in the cold water pipes (e.g., perhaps one to three feet of boost) causing a pressure differential in the hot water piping. With this arrangement, only one pump 16 per plumbing system (e.g., per water heater) is required with any reasonable number of remote faucet sets (e.g., the typical number used in residences). In alternative embodiments, the pump 16 may be located in other pump locations, such as in the hot water piping near the fixture 12, at the fixture 12, in the supply piping near the water heater 22, or the like.

In one embodiment, the pump 16 may operate twenty-four hours a day, with most of the time in the no flow mode. However, this is unnecessary and wasteful of electricity. Alternatively, the pump 16 can have a timer 24 to turn on the pump 16 daily at one or more times during the day just before those occasions when hot water is usually needed the most (e.g., for morning showers, evening cooking, etc.) and be set to operate continuously for the period during which hot water is usually desired. This still could be unnecessary and wasteful of electricity. Another alternative is to have the timer 24 cycle the pump 16 on and off regularly during the period when hot water is in most demand. The "on" cycles should be of sufficient duration to bring hot water to all remote fixtures 12, and the "off" period would be set to approximate the usual time it takes the water in the lines to cool-down to minimum acceptable temperature. By using a time-of-day control timer 24, the pump 16 operates to maintain "instant hot water" only during periods of the day when hot water is commonly desired. During the off-cycle times, the plumbing system operates just as if the pump 16 were not in place. This saves electrical power usage from pump operation and, more importantly, avoids the periodic introduction of hot water into relatively uninsulated pipes during the off-hours, thereby saving the cost of repeatedly reheating this water. The time-of-day control also avoids considerable wear and tear on the pump 16. Considerable additional benefits are gained by using a cyclic timer 24, with or without the time-of-day control.

Optionally, a sensor 26 may be provided within the water circulation system 10 to detect flow characteristics of water within the water circulation system 10, such as in the supply pipes. The sensor 26 may be used with or without the timer 24 to control the operation of the pump 16. The sensor 26 may be located at the pump 16 or the sensor 26 may be located elsewhere in the system, such as at the fixture, at the cold water pipe, at the hot water pipe, at the water heater 22, and the like. The sensor 26 may be sized to detect significant flows only (e.g., those flows that are much larger than flows through the valve assembly 14), such as a shower flowing. Optionally, the sensor 26 may constitute a flow sensor that operates to detect a flow characteristic of actual flow of water through the pipes or through the pump 16. The sensor 26 may also be coupled with an electrical switch, such as a reed switch, for controlling a component within the water circulation system 10, such as the pump 16, a valve, and the like. Optionally, the sensor 26 may be, or may include, a transducer.

In an alternative embodiment, the sensor 26 may constitute a pressure sensor that operates to detect a flow characteristic of either a pressure value at a particular point within the water circulation system 10, or a change in pressure within the water circulation system 10 to detect flow. Alternatively, the sensor 26 may constitute a temperature sensor that operates to detect a flow characteristic of temperature, such as a temperature value or a change in temperature to detect flow of water through the water circulation system 10. Alternatively, the sensor 26 may constitute a manually activated switch, a push button switch, a motion detector, a photo-detector, a noise detector, an infrared sensor, a door sensor, a floor pressure sensor, or an appliance activation sensor for activating the pump 16.

The sensor 26 may be located proximate (e.g. at or near) the supply pipes, proximate the return pipes, proximate the pump 16, proximate the water heater 22, proximate the valve assembly 14, proximate the fixture 12, within the same room as the fixture 12, within the piping system, or elsewhere within the building housing the water circulation system 10. In the illustrated embodiment, the system 10 includes a first sensor 26 (e.g. a flow sensor) near the water heater 22, attached to the hot water supply pipe, a second sensor 26 (e.g. a manually activated sensor) within the room having the fixture 12, and a third sensor 26 (e.g. a temperature sensor) in the return pipe. The third sensor may be positioned near the water heater 22, or alternatively, near the fixture 12, wherein the closer the third sensor 26 is to the fixture, the quicker the temperature in the return pipe may be sensed. The return pipe may be a dedicated return pipe 30 from the fixture 12 or may be the cold water supply pipe, through which recirculation flow is permitted. The location of the switches 26 depends upon factors such as the type of sensor 26, the type of system 10, the preference of the user, new or existing construction of the building, and the like.

The sensor 26 may communicate with a controller 28, which in turn communicates with the pump 16. The communication may be wired or wireless. The controller 28 may be separately provided from the pump 16 and the sensor 26, or alternatively, may be integral with the pump 16 and/or the sensor 26. In another alternative embodiment, the sensor 26 may communicate directly with the pump 16. The timer 24 may also communicate with the controller 28, and may be integral with the controller 28. In one embodiment, when the cyclic timer 24 is used, the sensor 26 may be wired in series with the pump motor, and the sensor 26 may prevent the motor from cycling if an existing flow is detected at the moment the timer calls for pump on. The use of such a sensor 26 accomplishes several useful objectives, including reducing electrical power usage and extending pump life if hot water is already flowing and there is no need for the pump to operate, avoiding a sudden temperature rise and the likelihood of scalding that could result from the pump boost if water is being drawn from a "mixing" valve (such as a shower or single handle faucet) and allowing use of a "large" pump (now that the danger of scalding is eliminated) with its desirable low pressure drop at high faucet flows, thereby eliminating the need for the parallel check valve 20 required with a "small" pump.

In alternative embodiments, the water circulation system 10 may also include at least one temperature sensor coupled to the pipes of the water circulation system 10 for providing temperature feedback to the pump 16. For example, the sensor 26 may be placed proximate and/or downstream of the most remote fixture within the water circulation system 10. The sensor 26 may be placed near the water heater 22 in a dedicated return pipe or the cold water return pipe. The operation of the pump 16 may be controlled by the temperature sensor, such as by turning the pump 16 on when the temperature of the water reaches a predetermined threshold, or alternatively, falls by a predetermined amount or at a predetermined rate. Similarly, the pump 16 may be turned off when the temperature of the water reaches a predetermined threshold, or alternatively, rises by a predetermined amount or at a predetermined rate. In another alternative embodiment, the pump 16 may be controlled based on the flow of water within the water circulation system 10. For example, by using the sensor 26 as a flow detector (e.g. a flow sensor, a pressure sensor, a temperature sensor, and the like), the operation of the pump 16 may be controlled based on flow characteristics of the water in the water circulation system 10. For example, when a user demands hot water, such as by turning on the faucet, the flow of water through the pipes and/or the pump may be detected and the pump 16 may be turned on. Other demand-type sensors may be provided to turn the pump on, such as pressing a manual switch, or by activating another type of sensor such as an IR sensor.

The valve assembly 14 includes a valve body 32 which is illustrated schematically in FIG. 1. The valve body 32 includes a bypass portion 34, which includes a bypass control unit for controlling the flow of water through the bypass portion 34. In an exemplary embodiment, a hot water supply line 36 and a cold water supply line 38 are both connected to the valve body 32. In homes or buildings that have a dedicated return line 30, the dedicated return line 30 is also connected to the valve body 32. The bypass portion 34 creates a flow path between the hot water supply line and at least one of the dedicated return line 30 and the cold water supply line 38. Cooled water from the hot supply line 36 is directed through the bypass portion 34 into the dedicated return line 30 or the cold supply line 38, and ultimately back to the water heater 22. Optionally, rather than directly connecting the hot supply, cold supply and dedicated return lines 36, 38, 30 to the valve body 32, fixture supply lines, such as flexible hoses, may be used to interconnect therebetween. In an exemplary embodiment, the valve body 32 and bypass portion 34 may be formed from a single integral body. Alternatively, the valve body 32 and bypass portions 34 may be formed from two or more portions that are separately fabricated and coupled to one another. In another alternative embodiment, an interconnection, such as a coupler or even a flexible pipe, may be provided between the portions.

Figure 2:
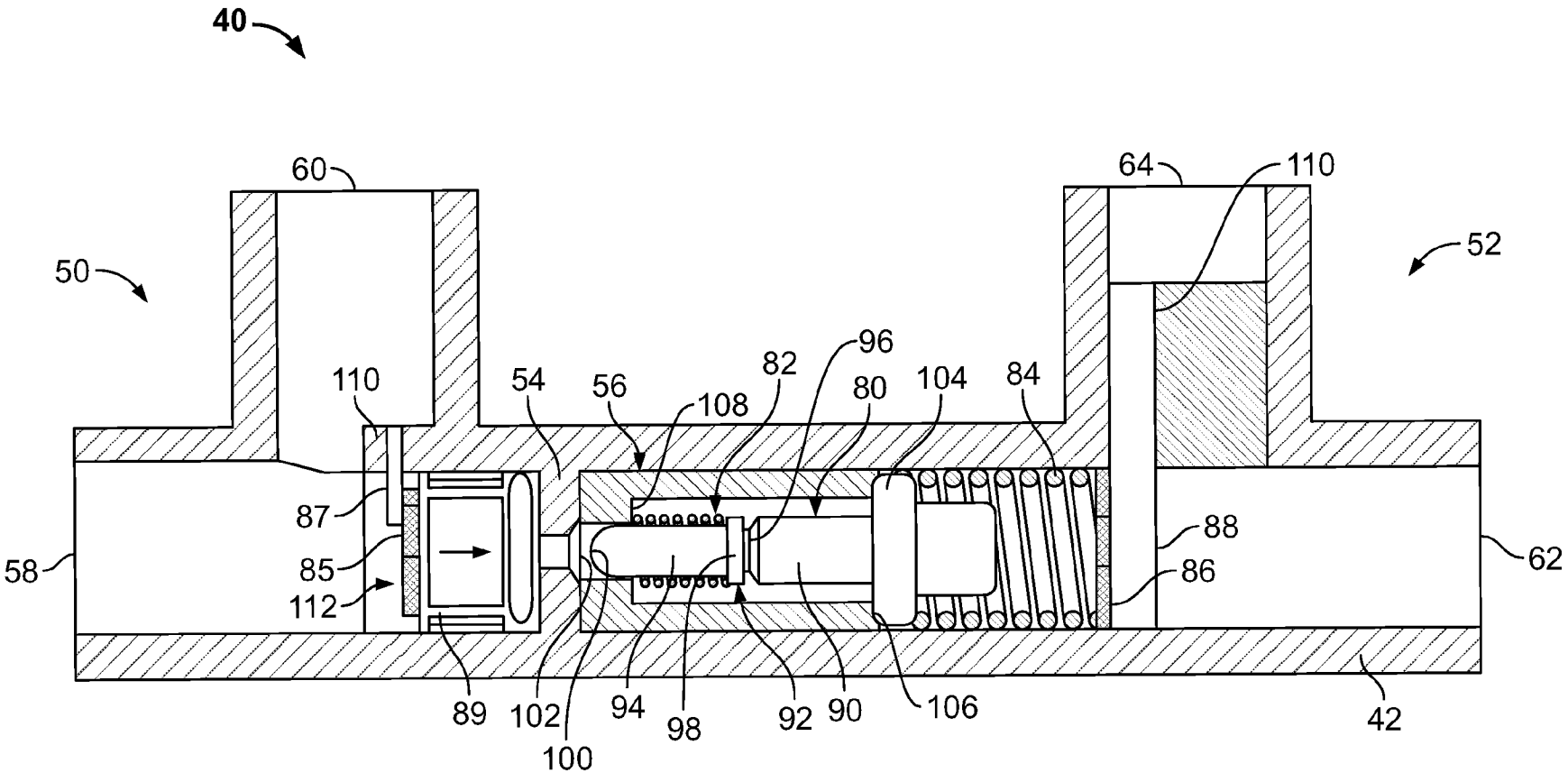
FIG. 2 is a side cutaway view of a prior art valve assembly.

FIG. 2 is a side cutaway view of a prior art valve assembly 40 that is adapted to be coupled between the hot and cold supply lines 36, 38 of the water circulation system 10 (shown in FIG. 1). The valve assembly is typically mounted within a cabinet below the fixture. The valve assembly 40 is not configured to be connected to a dedicated return line, such as return line 30 shown in FIG. 1.

The valve assembly 40 includes a valve body 42 that is generally tubular, and in the illustrated embodiment, is a single, unitary member having a first end 50, a second end 52 and a separating wall 54 disposed between the first end 50 and the second end 52. A passage 56 extends from the separating wall 54 to the second end 52. The passage 56 interconnects the first end 50 and the second end 52 and allows fluid to flow therethrough. In one embodiment, the valve body 42 is manufactured out of a molded plastic material having relatively high strength and chemical/corrosion resistant characteristics. The molded plastic material provides the ability to manufacture the valve body 42 utilizing injection molding processes with the design based on the configuration described herein without the need for expensive casting or machining. Alternatively, the valve body 42 can be manufactured from various plastics, reinforced plastics or metals that are suitable for "soft" plumbing loads and resistant to hot chlorinated water under pressure.

The valve body 42 has four threaded ports, an axial and radial port at the first end 50 and an axial and radial port at the second end 52. The first end 50 is designated to receive and discharge hot water and the second end 52 is designated to receive and discharge cold water from a source of cold water, such as a city water supply system or a local water well. While other configurations are possible in alternative embodiments, in the illustrated embodiment, the axial ports are designated as inlet ports and the radial ports are designated as discharge ports. For example, at the first end 50 (the hot water side) is a first inlet port 58 and a first discharge port 60 and at the second end 52 (the cold water side) is a second inlet port 62 and second discharge port 64. Conversely, the radial ports can be the inlet ports and the axial ports can be the discharge ports, or a combination thereof. Additionally, more or less ports may be provided, such as a single discharge port. As discussed in detail below, the first and second inlet ports 58, 62 connect to the hot and cold water distribution system and the first and second discharge ports 60, 64 connect to the hot and cold water valves on the fixture (i.e., sink, shower, bathtub or etc.) with which the valve assembly 40 is utilized.

In an exemplary embodiment, the bypass portion 34 of the valve body 42 includes a flow control unit for controlling the flow of water through the bypass portion 34. In the illustrated embodiment, the flow control unit is represented by a thermally sensitive actuating element 80. However, in alternative embodiments, other types of devices may be used to control flow through the bypass portion. For example, the device may be electrically actuated, hydraulically actuated, pneumatically actuated, and the like. The flow control unit may be thermally actuated, such as the actuating element 80 or other types of thermally actuated devices, or the flow control unit may be actuated in response to other types of stimuli, such as pressure, flow, manual activation, and the like.

In the illustrated embodiment, the valve body 42 houses the thermally sensitive actuating element 80 in addition to a bias spring 82, an over-travel spring 84, first and second screens 85 and 86, first and second retaining pins 87 and 88, and may house a check valve 89. The thermally sensitive actuating element 80 may be of the wax filled cartridge type, also referred to as wax motors, having an actuator body 90 and an integral piston/poppet rod member 92. The rod member 92 includes a poppet 94 attached to a piston 96 with an intermediate flange 98 thereon. The piston 96 of the rod member 92 interconnects the poppet 94 with the actuator body 90. An end 100 of the poppet 94 seats against a valve seat 102 at the separating wall 54 to close the passage 56. The actuator body 90 has a section 104 of increased diameter to seat against a shoulder 106 in the valve body 42. The over-travel spring 84 abuts against one side of the section 104 and the opposed side of the section 104 abuts against the shoulder 106.

An internal shoulder 108 is provided inside valve body 42 at an end of the passage 56 for fixedly receiving and positioning one end of the bias spring 82. The other end of the bias spring 82 engages the rod member 92, and generally forces the rod member 92 toward the actuator body 90. Optionally, the valve assembly 40 may be operated without the bias spring 82. For example, the actuating element 80 may be formed using a shape memory alloy that has linear memory characteristics, such as, but not limited to, a nickel-titanium alloy, a copper-zinc-aluminum alloy, a copper-aluminum-nickel alloy, and the like.

Retaining pin holes 110 are provided in the valve body 42 for receiving the retaining pins 87 and 88. The first end 50 is molded with a retaining slot 112 for receiving with the check valve 89 and the retaining pin 87 is used to hold the check valve 89 in place. The first screen 85 is also positioned in the passage 56 and retained by the first retaining pin 87. The screen 85 can be a small wire fabric, mesh-type screen that is shaped and configured to fit within the first end 50 of the valve body 42. The screen 85 is utilized to keep hard water lime particles and other detritus out of the bypass portion 34. As such, the debris and/or minerals do not interfere with the operation of the actuating element 80, such as by blocking the closing of the passage 56 by the poppet 94.

As described above, the section 104 of the actuator body 90 having an increased diameter seats against the shoulder 106. The over-travel spring 84 is disposed between the section 104 and the second retaining pin 88 located inside valve body 42 proximate the second end 52. The over-travel spring 84 prevents damage to a fully restrained actuating element 80 heated above a maximum operating temperature and to hold the actuating element 80 in place during operation without concern for normal tolerance. The over-travel spring 84 allows movement of the actuator body 90 away from the shoulder 106 in the event that temperature rises substantially. Without this relief, the expanding wax would distort the casing, destroying the calibrated set point. The over-travel spring 84 also holds the bias spring 82, rod member 92 and actuator body 90 in place without the need to adjust for the stack-up of axial tolerances. Alternatively, the actuating element 80 can be fixedly placed inside the valve body 42 by various mechanisms known in the art, including adhesives and the like. The over-travel spring 84 can be held in place by various internal configurations commonly known in the art, such as a molded seat. In an exemplary embodiment, however, the over-travel spring 84 abuts against the second screen 86, which is held in place by the second retaining pin 88. The screen 86 can be a small wire fabric, mesh-type screen that is shaped and configured to fit within the second end 52 of the valve body 42. The screen 86 is utilized to keep hard water lime particles and other detritus out of the bypass portion 34 and to act as a seat for the over-travel spring 84.

In operation, the actuating element 80 is movable between an open position and a closed position. In the open position, water is allowed to flow through the passage 56 from the first end 50 to the second end 52. As such, water flows from the hot side to the cold side of the valve assembly 40. In this way, the cooled water may be dispelled from the hot water lines, thus bringing hot water to the hot side of the valve assembly 40 for dispensing at the fixture. In the closed position, the poppet 94 seats against the valve seat 102 and water is restricted from flowing through the passage 56.

In the exemplary embodiment, the actuating element 80 is movable between the open and closed positions based on a temperature of the water. For example, the actuator body 90 includes a wax or a mixture of wax and metal powder (i.e., copper powder) enclosed in the actuator body 90 by means of a membrane made of elastomer or the like. Upon heating, the wax or wax with copper powder mixture slowly expands, thereby pushing the piston 96 and poppet 94 in an outward direction. Upon cooling, the wax or wax/copper powder mixture contracts and the rod member 92 is pushed inward by the bias spring 82 until the flange 98 contacts the actuator body 90 at an actuator seat. The wax filled cartridge type of thermal actuator allows the wax to be formulated to change from the solid to the liquid state at a particular desired temperature. The rate of expansion with respect to temperature at this change of state results in almost snap action of the actuating element 80. The temperature set point is equal to a preset value, such as 97 degrees Fahrenheit, desired for the hot water. A "sudden" large physical motion is provided over a small temperature change, such as, for example, 5 degrees. Additionally, the higher the temperature of the water flowing past the actuating element 80, the more the actuating element 80 expands. As stated above, this movement is reacted by the bias spring 82, which returns the rod member 92 as the temperature falls. In alternative embodiments, a wax blend may be used having a gradual expansion rather than a sudden or snap action. For example, a mix of waxes, each having different temperatures at which the wax turns from a solid to a liquid, may be combined to provide a steady closing action rather than the snap action. These waxes may be combined into the same blend or may be individually provided, and separated from one another, within the actuator body 90. In other alternative embodiments, other types of thermal actuators, such as bimetallic springs and memory alloys (i.e., Nitinol and the like) may be utilized. The valve body 42 is designed so the components of the bypass portion 32 can fit through either of the inlet and/or discharge ports, such as with a snap-in fit. In this manner, no intermediate or additional joints are required for installation.

Figure 4:
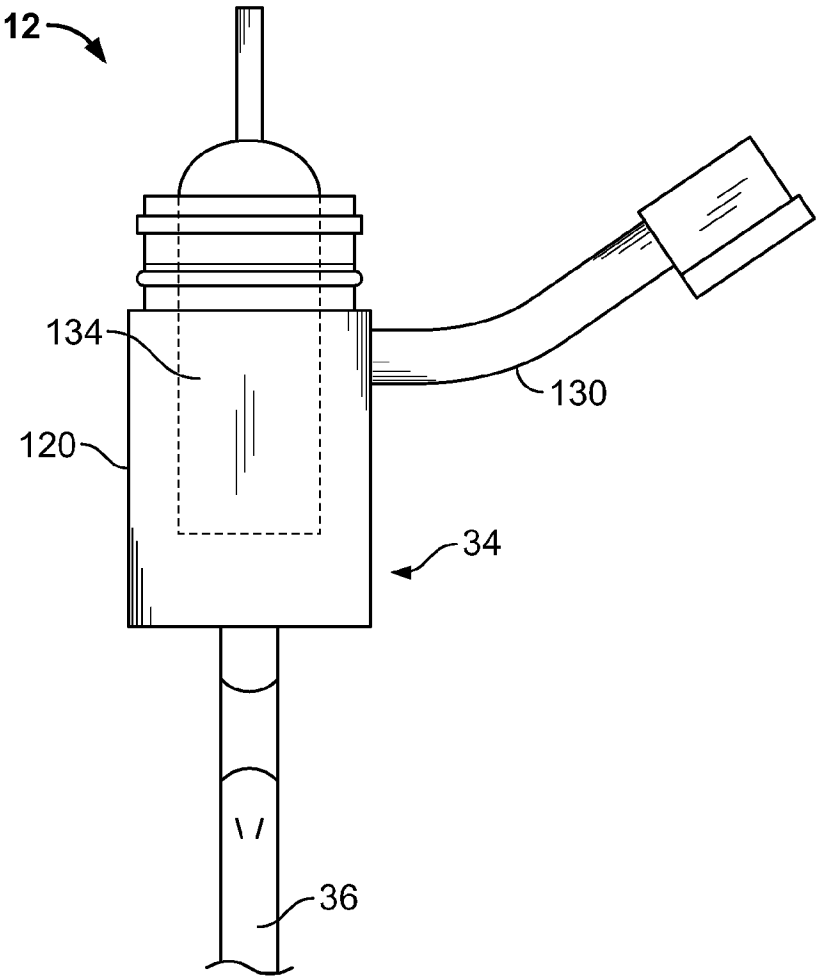
FIG. 4 is a side view of the fixture shown in FIG. 3.
Figure 3:
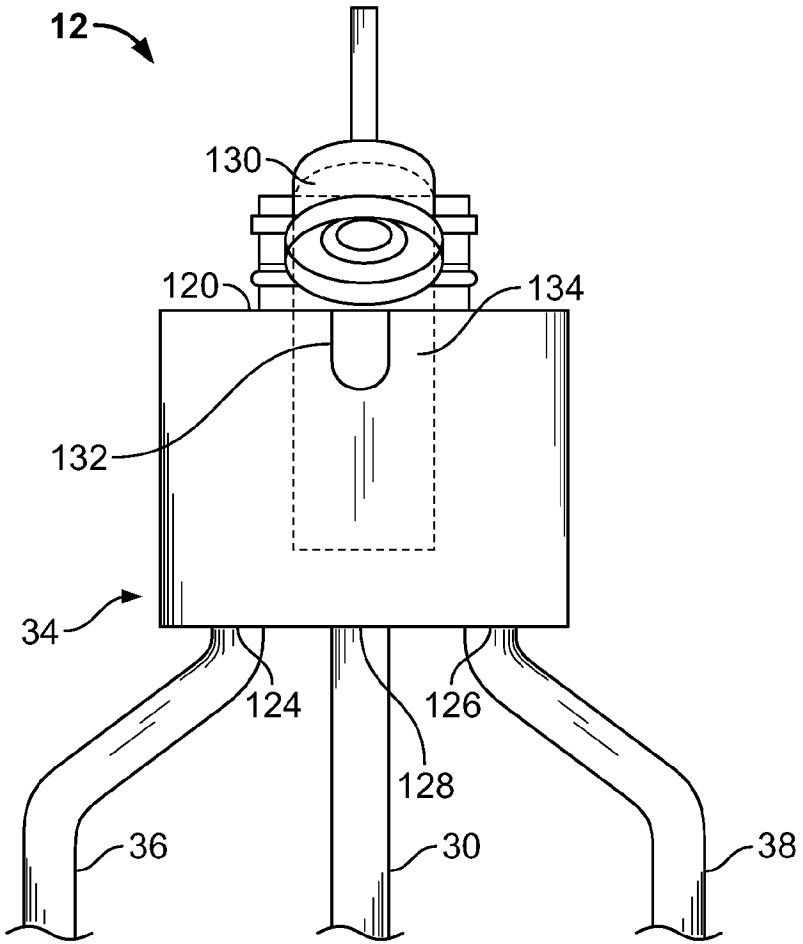
FIG. 3 is a front view of an exemplary fixture for use with the water circulation system.
Figure 5:
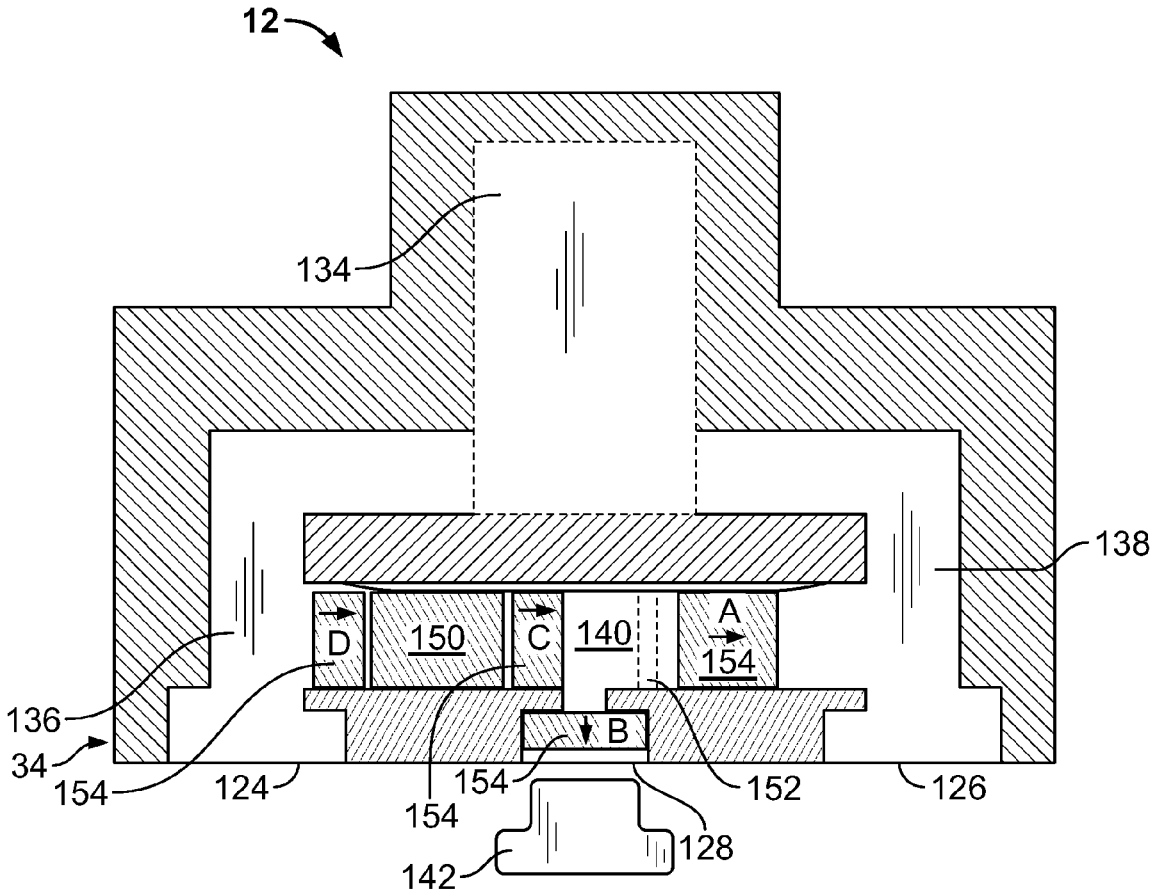
FIG. 5 is a sectional view of the fixture shown in FIG. 3.

FIG. 3 is a front view of an exemplary fixture 12 with a decorative cover portion of the fixture 12 removed showing a fixture housing or body 120. FIG. 4 is a side view of the fixture 12. FIG. 5 is a sectional view of the fixture 12. The bypass portion 34 of the fixture 12 is adapted for permitting recirculating flow through the fixture 12, as described in further detail below. In the illustrated embodiment of FIGS. 3-5, the fixture 12 represents one type of sink faucet, such as a single handle sink faucet. It is realized that other types of faucets may be used, such as double handle faucets, dual spout faucets, and the like.

As illustrated in FIGS. 3 and 4, the hot supply line 36, cold supply line 38 and dedicated return line 30 are each connected to the fixture housing 120. The hot supply line 36 is connected to a hot water inlet port 124. The cold supply line 38 is connected to a cold water inlet port 126. The dedicated return line is connected to a dedicated hot water return port 128. An outlet spout 130 is coupled to the fixture housing 120 at a discharge port 132. Optionally, multiple spouts and outlet ports may be provided on the fixture housing 120. An internal flow control unit 134, such as a pivoting and rotating ball, may be integrated into the housing 120. In an alternative embodiment, the flow control unit 134 may be another type of flow control device, such as a cartridge type of valve. The flow control unit 134 selectively and adjustably controls the volume and/or temperature of the flow of water by connecting the hot and cold lines 36, 38 to the outlet spout 130. Other types of flow control devices may similarly be used to control the volume and/or temperature of the flow of water to the outlet spout 130.

FIG. 5 illustrates an exemplary embodiment of the fixture 12. The flow control unit 134 is schematically illustrated in FIG. 5 and shown in phantom. The flow control unit 134 is fluidly coupled to the hot water inlet port 124 by a hot water passage 136 within the fixture housing 120. The flow control unit 134 is also fluidly coupled to the cold water inlet port 126 by a cold water passage 138 within the fixture housing 120. The flow control unit mixes the hot and cold water and dispenses the mixed water through the discharge port 132 (shown in FIGS. 3 and 4). For example, the flow control unit 134 may be moved such that the flow control unit 134 is selectively positionable to control the amount of water being supplied from each of the passages 136, 138. The flow control unit 134 may be translated or rotated to different positions.

In an exemplary embodiment, the bypass portion 34 of the fixture 12 includes a bypass passage 140 interconnecting the hot water passage 136 with the dedicated return port 128 and the cold water passage 138. As such, hot water recirculation is permitted through either the return port 128 or the cold water passage 138 and then the cold water inlet port 126. The particular type of recirculation (e.g. dedicated return or cold water line return) may be selected during installation of the fixture 12. As such, the fixture 12 may be utilized in different types of plumbing systems within the particular home/building. If the home/building were equipped with a hot water dedicated return line, then the dedicated return line 30 is plumbed to the return port 128. However, if the home/building were not equipped with a dedicated return line, then the fixture 12 would be plumbed to the hot and cold supply lines 36, 38, and recirculation would occur through the cold supply line 38. In such an embodiment, flow through the return port 128 may be restricted by a flow restriction device, such as by a plug 142 that is received within an end of the return port 128. The plug 142 is removable with respect to the valve body 32 (shown in FIG. 1), to allow for one of the alternative plumbing methods. Optionally, the plug 142 may be threadably coupled to the fixture housing 120. Alternatively, the plug 142 may be secured to the fixture housing 120 by an alternative fastening means, such as soldering.

In an alternative embodiment, rather than a plug, the flow restriction device may include a valve, such as a three-way valve that is coupled to, or received within, the fixture housing 120 to selectively control the flow of water therethrough. For example, in a first position, the three-way valve may allow flow from the hot side to the cold water inlet port 126 and restrict flow to the dedicated hot water return port 128. In a second position, the three-way valve may restrict flow from the hot side to the cold water inlet port 126 and allow flow to the dedicated hot water return port 128. As such, when the fixture housing 120 is installed, the three-way valve may be selectively positioned based on the type of recirculation system being used within the particular home/building (e.g. dedicated return or cold water line return). Alternatively, another type of valve, such as a gate valve or a ball valve may be provided within the fixture housing 120 to restrict flow only to the dedicated hot water return port 128. As such, if the fixture housing 120 is being used with a dedicated return line type of system, the valve may be opened, allowing flow to the return port 128, but if a cold return line system is used, the valve may remain closed.

Flow through the bypass portion 34 is controlled by a bypass flow control unit 150, which is illustrated schematically in FIG. 5. The bypass flow control unit 150 is positioned within the bypass passage 140 that is downstream of the hot water passage 136. Optionally, the bypass flow control unit 150 may be a thermally sensitive actuating element, such as the actuating element 80 illustrated in FIG. 2. Alternatively, the bypass flow control unit 150 may be a different type of device for controlling the flow of water through the bypass passage 140, such as a wax motor type of device, an electrically actuated valve, a solenoid controlled bypass valve, a needle-type bypass valve, a hydraulically actuated valve, a pneumatically actuated valve, and the like. The bypass flow control unit 150 is generally operated to restrict or allow flow through the bypass portion 34 based on at least one predetermined characteristic, such as time, water temperature, water pressure, water flow rate, a manual activation, and the like. Optionally, the bypass passage 140 may have an opening sized approximately the same as the hot water passage 136, which allows a high flow rate of water therethrough to quickly re-circulate water through the fixture 12. Alternatively, a wall may be provided with a small opening to the bypass passage 140 to allow a smaller flow of water through the bypass passage 140, which allows a low flow rate of water therethrough to more slowly re-circulate water through the fixture 12. Alternatively, when the bypass portion 34 is used for an alternative function other than hot water recirculation, the bypass passage 140 may be used to interconnect the bypass portion 34 with at least one of the hot water inlet port 124 and/or the cold water inlet port 126.

In an exemplary embodiment that utilizes the dedicated hot water return port 128 to recirculate the water through the fixture 12, a wall 152 (shown in phantom in FIG. 5) may be provided to separate the hot and cold sides of the fixture 12. In particular, the wall 152 restricts water flow from the hot water inlet port 124 to the cold water inlet port 126, and vice versa. Recirculation through the fixture 12 is permitted only through the dedicated hot water return port 128. In such an embodiment, no plug 142 is used to restrict flow through the return port 128.

The fixture 12 may also utilize at least one flow restrictor, such as a check valve 154, to control the flow of water through the bypass passage 140 in addition to the bypass flow control unit 150. While the following description of the flow restrictors are in terms of check valves 154, the flow restrictors are not intended to be limited to check valves. FIG. 5 illustrates four exemplary locations for the check valves 154, namely A, B, C and D. In an exemplary embodiment, two check valves 154 are provided, with one at location A and another at any of locations B, C or D. Arrows are provided to indicate the flow direction through the check valves 154. The check valve 154 at location A restricts water flow from the cold side of the fixture 12 into the hot side of the fixture 12. The check valve at any of locations B, C or D restricts water flow from the dedicated return port 128 into the hot side of the fixture 12.

The check valves 154 allow water to flow therethrough when the water pressure is above a predetermined threshold. For example, when the pump 16 is operated, and when the bypass flow control unit 150 is open, the pressure of the water is great enough to overcome the force holding the check valve closed. For example, a spring is used to hold a ball against a seat within the check valve 154. When the pump 16 is operated, the pressure of the water flowing through the hot water inlet port is greater than the spring force holding the ball against the seat, and the check valve 154 is opened, which allows water to flow therethrough. In an exemplary embodiment, the check valve 154 at location A has a different, higher, spring pre-load the check valve 154 at location B, C or D such that the force needed to overcome the spring force holding the check valve 154 at location A closed is higher then the force needed to overcome the spring force holding the check valve at location B, C or D closed. As such, the spring of check valve 154 at location A is a heavy spring and the spring of check valve 154 at location B, C or D is a light spring. The different spring pre-loads are particularly useful when the recirculating flow is desired through the dedicated hot water return port 128 (e.g. the plug 142 is removed and a dedicated return is coupled to the return port 128) and when the check valve 154 is at location B, such that the water flowing through the bypass passage 140 is first directed through the check valve 154 at location B because the check valve 154 at location B has a lower spring pre-load. As long as the check valve at location B is open, the pressure of the water should not exceed the spring pre-load of the check valve 154 at location A. As such, all recirculating flow occurs through the dedicated hot water return port 128 and not through the cold water inlet port 126. Additionally, once the bypass flow control unit 150 is closed (e.g. the temperature of the water is at an acceptable level), then water is restricted from flowing to either the dedicated hot water return port 128 or the cold water inlet port 126.

In an alternative embodiment, a flow restrictor, such as a check valve 154, may be positioned only at location B to restrict water from flowing from the dedicated hot water return port 128 into the bypass passage 140. The check valve 154 allows water flow from the bypass passage 140 when the pump 16 is operated and when the bypass flow control unit 150 is open. Optionally, the bypass flow control unit 150 may not be provided within the bypass portion 34. Rather, the check valve 154 controls the flow within the bypass portion 34. Such a system defines a pressure based bypass system, in that the pressure differential created by the pump drives the flow through the bypass portion 34.

Figure 6:
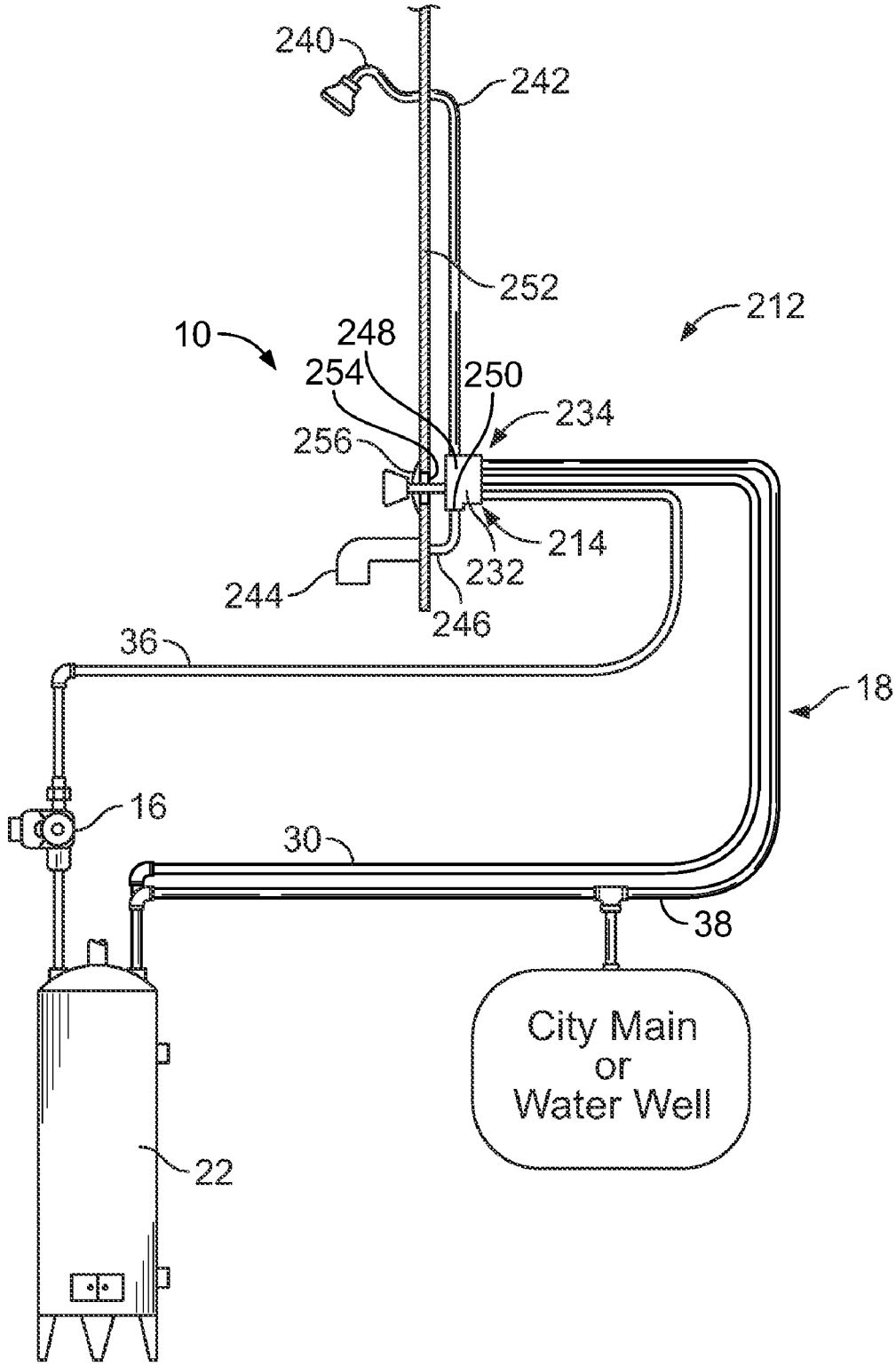
FIG. 6 illustrates a water circulation system and fixture utilizing a valve assembly in accordance with another exemplary embodiment.

FIG. 6 illustrates the water circulation system 10 and an alternative fixture 212, represented by a tub/shower type of fixture, in accordance with another exemplary embodiment. However, the fixture 212 may be another fixture type such as a dishwasher, a washing machine, and the like in other alternative embodiments. The fixture 212 utilizes a valve assembly 214, which is illustrated in FIG. 6 as a tub/shower valve 214.

The water circulation system 10 is similar to the water circulation system 10 illustrated in FIG. 1, and like components are identified with like reference numerals. For example, the water circulation system 10 includes the circulating pump 16 to achieve the desired circulation flow through the piping system 18. The pump 16 is located at or near the water heater 22. When operated, the pump 16 boosts the pressure in the hot water piping somewhat above that in the cold water pipes (e.g., perhaps one to three feet of boost) causing a pressure differential in the hot water piping.

The valve assembly 214 includes a valve body or housing 232 which is illustrated schematically in FIG. 6. The valve body 232 may include a bypass portion 234, which includes a bypass control unit for controlling the flow of water through the bypass portion 234. In an exemplary embodiment, the hot water supply line 36 and the cold water supply line 38 are both connected to the valve body 232. In homes or buildings that have the dedicated return line 30, the dedicated return line 30 is also connected to the valve body 232. The bypass portion 234 creates a flow path between the hot water supply line 36 and at least one of the dedicated return line 30 and the cold water supply line 38. Cooled water from the hot supply line 36 is directed through the bypass portion 234 into the dedicated return line 30 or the cold supply line 38, and ultimately back to the water heater 22.

As is well known, many homes have a combination shower and tub fixture 212 whereby the same valve assembly 214 is used to control the flow and temperature to the shower and the tub. A selector valve (not shown) is used to select the flow between the shower and the tub. A similar valve assembly 214 may be used for systems having only a shower or a tub, with the exception that such valve assemblies only have one discharge port (e.g. connected to either the shower or the tub faucet). In the shower/tub fixture 212, the valve assembly 214 with associated bypass portion 234, distributes water to a shower head assembly 240 through a shower line 242 and to a tub faucet 244 through a tub line 246. A flow control unit is used to control the flow and temperature of water to the shower head assembly 240 or tub faucet 242. The valve assembly 214 includes a first discharge port 248 in fluid communication with the shower line 242 and a second discharge port 250 in fluid communication with the tub line 246. Optionally, a single flow control unit may be utilized. Alternatively, multiple flow control units may be used to control the flow of hot and cold water separately.

The valve assembly 214 is generally positioned at least partially behind a support wall 252 that forms part of the shower and/or tub enclosure and which is used to support the shower head assembly 240 and the tub faucet 244. Because access to the valve assembly 214 is important for maintenance, repair or replacement of the valve assembly 214, the valve assembly 214 is generally placed behind an opening 254 in the support wall 252 specifically configured for accessing the valve assembly 214. Typically a removable plate 256, commonly referred to as an escutcheon plate, is used to cover the opening 254.

Figure 7:
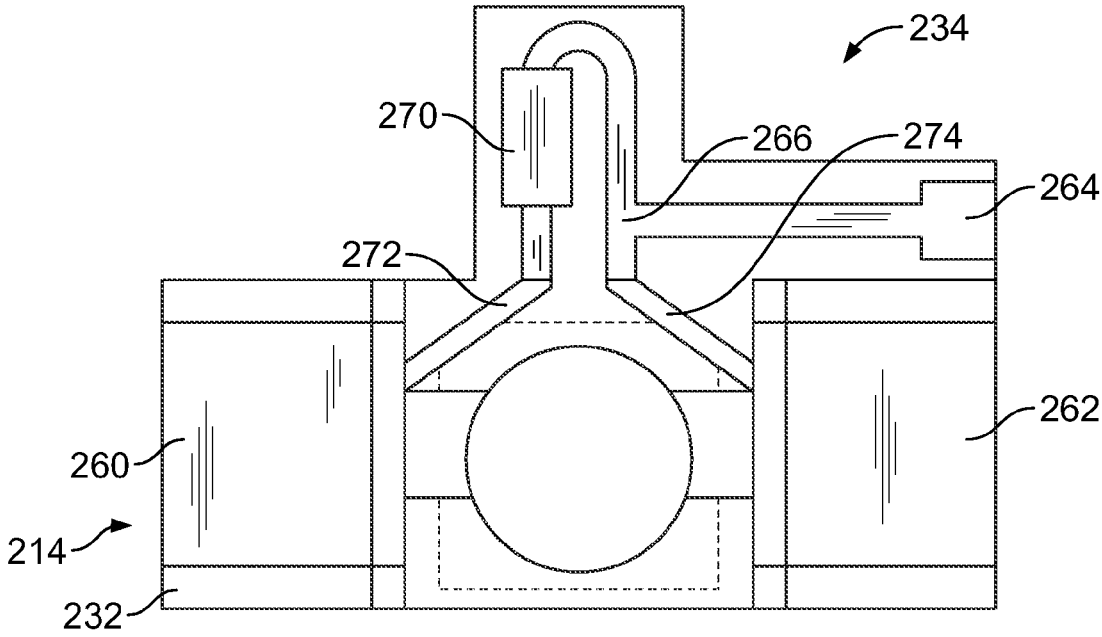
FIG. 7 is a sectional view of a valve portion of the fixture shown in FIG. 6.

FIG. 7 is a sectional view of the valve assembly 214 for the fixture 212 (shown in FIG. 6). The valve body 232 includes a plurality of inlet ports, such as a hot water inlet port 260 and a cold water inlet port 262. The valve body 232 also includes an auxiliary port 264 allowing an auxiliary flow through the valve assembly 214. In an exemplary embodiment, the auxiliary port 264 defines a dedicated hot water return port 264 that is configured to be coupled to the dedicated return line 30. Alternatively, rather than use as a dedicated return port for an auxiliary bypass function, the auxiliary port 264 may be used for another auxiliary function, such as an antiscald function, a pressure balance function, or another function for the valve assembly 214 that may make use of an auxiliary port.

In the illustrated embodiment, the auxiliary port 264 defines the dedicated hot water return port 264. The bypass portion 234 includes a bypass passage 266 therein. Flow through the bypass portion 234 is controlled by a bypass flow control unit 270, which is illustrated schematically in FIG. 7. The flow control unit 270 is positioned within the bypass passage 266. Optionally, the bypass flow control unit 270 may be a thermally sensitive actuating element, such as the actuating element 80 illustrated in FIG. 2. Alternatively, the bypass flow control unit 270 may be a different type of device for controlling the flow of water through the bypass passage 266, such as a wax motor type of device, an electrically actuated valve, a solenoid controlled bypass valve, a needle-type bypass valve, a hydraulically actuated valve, a pneumatically actuated valve, and the like.

In one exemplary embodiment, the bypass passage 266 is fluidly coupled to the hot water inlet port 260 by a hot water bypass passage 272 within the valve body 232. The bypass passage 266 may also be fluidly coupled to the cold water inlet port 262 by a cold water bypass passage 274 within the valve body 232. As such, recirculation may be accomplished through the cold water inlet port 262, such as when a dedicated return line 30 is not connected to the valve assembly 214. Alternatively, when the bypass portion 234 is used for an alternative function other than hot water recirculation, the cold water bypass passage 274 may be used to interconnect the bypass portion 234 with the cold water inlet port 262. Optionally, the bypass portion 234 may include check valves therein, similar to the embodiment described with reference to FIG. 5, to control the flow of water through the bypass passage 266.

Figure 8:
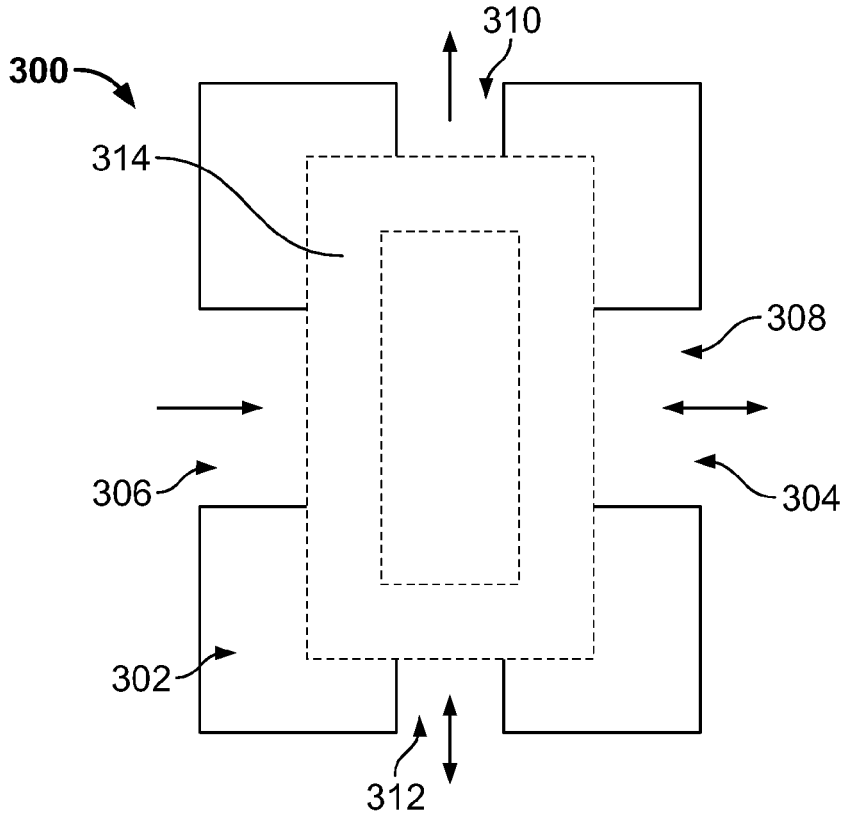
FIG. 8 illustrates another exemplary valve assembly for the water circulation system shown in FIG. 1.

FIG. 8 schematically illustrates a water control fixture 300 that may be used within the water circulation system 10 (shown in FIG. 1 or 6). For example, the fixture 300 may be a sink/spout type of fixture, a tub/shower type of fixture, an appliance type of fixture, or another type of fixture utilized within the water circulation system 10. The water control fixture 300 includes a housing or body 302 having a plurality of ports 304. In the illustrated embodiment, the housing 302 includes four ports 304, however, more ports may be provided in alternative embodiments. In the illustrated embodiment, the four ports 304 represent a hot water inlet port 306, a cold water port 308, a discharge port 310 and an auxiliary port 312.

In an exemplary embodiment, the housing 302 includes at least one flow control unit 314 provided within the housing 302. The flow control unit 314 may be an operating valve of the fixture 300 for controlling flow from the fixture 300 through the discharge port 310, or the flow control unit 314 may be an auxiliary flow control device for controlling auxiliary flow through the fixture 300, or the flow control unit 314 may be both. The flow control unit 314 is schematically illustrated in phantom, and may be one of many known types of flow control devices, such as, but not limited to, a thermally sensitive actuating element, such as the actuating element 80 shown in FIG. 2, an electrically actuated valve, a solenoid controlled bypass valve, a needle-type bypass valve, a hydraulically actuated valve, a pneumatically actuated valve, and the like. The flow control unit 314 is configured to control the flow of water within the housing 302. For example, the flow control unit may have multiple passages and/or chambers therein that interconnect, and direct the flow of water to, various ones of the ports 304. The flow control unit 314 is fluidly coupled to at least some of the ports of the housing 302 to direct flow therebetween. Optionally, the flow control unit may be selectively positionable within the housing 302 to control the flow of water through the flow control unit. For example, the flow control unit may be moved axially toward or away from one of the ports 304 to fluidly couple and/or uncouple from the port. The flow control unit may be rotated to fluidly couple and/or uncouple from one of the ports. The flow control unit may have a moving component therein that opens or closes a passage connecting one of the ports.

Optionally, the housing 302 may include more than one flow control unit that are in fluid communication with different ones of the ports 304. Different ones of the flow control units may be in fluid communication with at least some of the same ports 304. Optionally, one of the flow control units may be received within another of the flow control units. Alternatively, the various flow control units 314 may be received within different chambers within the housing 302 and the chambers may or may not be in fluid communication with one another.

In an exemplary embodiment, the hot water inlet port 306 is coupled to a hot water supply line and water from the hot water supply line is permitted to flow into the housing 302 through the hot water inlet port 306. The cold water port 308 is coupled to a cold water supply line and water from the cold water supply line is permitted to flow into the housing 302 through the cold water port 308. In at least one embodiment, water is also permitted to flow from the housing 302 through the cold water port 308. For example, in some embodiments, hot water recirculation is permitted through the cold water supply line to the hot water heater. The discharge port 310 is connected to a line or a spout through which water is dispensed from the fixture 300. The auxiliary port 312 is connected to a line, passage, device, or the like, for performing an auxiliary function, examples of which are described below.

In an exemplary embodiment, the fixture 300 generally performs a hot/cold mixing function. The flow control unit 314 may be a mixing valve that interconnects the hot and cold water inlet ports 306, 308 to the discharge port 310. Depending on the position of the flow control unit 314, the volume and/or temperature of the water discharged through the discharge port 310 may be controlled.

In one embodiment, the fixture 300 performs a bypass function. Optionally, the fixture 300 may perform the bypass function by interconnecting the hot and cold inlet water ports 306, 308. The flow control unit 314 controls the amount of flow from the hot water inlet port 306 to the cold water inlet port 308 and permits recirculating flow through the cold water inlet port 308. Optionally, the flow control unit may be the same flow control unit that performs the hot/cold mixing function. Alternatively, the additional flow control unit 314 may be provided within the housing to perform the bypass function. For example, the flow control unit 314 may be a bypass valve provided within the housing 302 for permitting bypass flow.

In an alternative embodiment, the fixture 300 performs a bypass function utilizing the auxiliary port 312 rather than the cold water port 308. For example, the flow control unit 314 may interconnect the hot water inlet port 306 and the auxiliary port 312, which defines a dedicated hot water return port that is connected to a dedicated return line. Optionally, the fixture 300 may be adapted to perform the bypass function using either the dedicated return type of bypass or the cold water return type of bypass. The installer or the user may be able to determine the type of recirculation based on the type of recirculation system that is available in the home/building. For example, a plug or cap may be provided for restricting flow through the auxiliary/dedicated return port 312, wherein if the cap is removed flow is allowed through the port 312, but if the cap is present, flow is restricted through the port 312 and the recirculation flow defaults to the cold water port 308.

In one embodiment, the fixture 300 performs an antiscald function. The flow control unit 314 controls either the flow rate or the temperature of the water discharged through the discharge port 310, such that the water will not burn the user. Optionally, the flow control unit 314 may include an antiscald device therein, or proximate thereto, that is in fluid communication with the auxiliary port 312. The antiscald device is configured to shut off flow from the discharge port 310 when the water pressure or the water temperature is above a predetermined amount. Alternatively, the antiscald device changes the flow from one of the hot water inlet port 306, the cold water port 308 and the auxiliary port 312 to change the mixture of the water dispensed from the fixture outlet port when the water temperature is above a predetermined amount. In one embodiment, the auxiliary port 312 is in fluid communication with the cold supply line and provides additional cold water supply to the fixture 300, such that when the pressure of the water flowing through the cold water inlet port 308 drops, such as when a toilet is flushed, and the mixture of the hot and cold water is skewed to be hotter, the antiscald device may allow a greater flow of cold water from the auxiliary port 312 to readjust or balance the hot and cold water. Alternatively, the antiscald device may sense a temperature of the water and when the water is too hot, the antiscald device may allow an increased flow from the auxiliary port 312 to reduce the temperature of the water discharged through the discharge port 310.

In another embodiment, the fixture 300 performs a pressure balance function. The flow control unit 314 may control the flow rate of the water discharged through the discharge port 310, such that the water temperature is controlled. Optionally, the flow control unit 314 may include a pressure balance device therein, or proximate thereto, that is in fluid communication with the auxiliary port 312. The pressure balance device changes a mixture ratio of water from at least one of the hot water inlet port 306, the cold water inlet port 308 and the auxiliary port 312 when a pressure of the water flowing through at least one of the hot water inlet port 306, the cold water port 308 and the auxiliary port 312 fluctuates. In one embodiment, the auxiliary port 312 is in fluid communication with the cold supply line and provides additional cold water supply to the fixture 300, such that when the pressure of the water flowing through the cold water inlet port 308 drops, such as when a toilet is flushed, and the mixture of the hot and cold water is skewed to be hotter, the pressure balance device may allow a greater flow of cold water from the auxiliary port 312 to readjust or balance the hot and cold water.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A water control fixture, comprising:

a housing having at least four ports, wherein the at least four ports include a hot water inlet port, a cold water inlet port, a fixture discharge port and a dedicated hot water return port;

a flow control unit operatively associated with the housing and the at least four ports, wherein the flow control unit fluidly couples the at least four ports in multiple combinations of ports to perform different functions, wherein a first set of the ports is fluidly coupled to perform a first function and a second set of the ports is fluidly coupled to perform a second function, wherein the flow control unit fluidly couples the hot water inlet port, the cold water inlet port, and the fixture discharge port to perform a hot/cold mixing function, and wherein the flow control unit fluidly couples the hot water inlet port and both of the dedicated hot water return port and the cold water inlet port to perform a hot water recirculation function through at least one of the dedicated return port and the cold water inlet port; and a flow restriction member, wherein hot water recirculation flow occurs through the cold water inlet port when the flow restriction member is used, and wherein hot water recirculation flow occurs through the dedicated hot water return port when the flow restriction member is not used.

2. The water control fixture of claim 1, wherein the flow control unit fluidly couples the auxiliary port and the fixture discharge port to perform an anti-scald function.

3. The water control fixture of claim 1, wherein the flow control unit fluidly couples the auxiliary port and the fixture discharge port to perform a pressure balance function.

4. The water control fixture of claim 1, wherein the flow restriction member comprises a plug received within the housing for restricting recirculating flow through the dedicated hot water return port.

5. The water control fixture of claim 1, wherein the at least four ports include an auxiliary port, the water control fixture further comprising an antiscald device in fluid communication with the auxiliary port, wherein the antiscald device shuts off flow from the fixture outlet port when the water pressure is above a predetermined amount.

6. The water control fixture according to claim 1, wherein the at least four ports include an auxiliary port, the water control fixture further comprising a pressure device in fluid communication with the auxiliary port, wherein the pressure device changes a mixture ratio of water from at least one of the hot water inlet port, the cold water port and the auxiliary port when a pressure of the water flowing through at least one of the hot water inlet port, the cold water port and the auxiliary port fluctuates.

7. A water control fixture, comprising:

a housing having a chamber and a plurality of ports in fluid communication with the chamber, the plurality of ports defining a hot water inlet port, a cold water port configured to be in fluid communication with a cold water supply line, a bypass port, and a fixture outlet port, wherein water is dispensed via the fixture outlet port; and a flow control unit received within the chamber and in fluid communication with the plurality of ports for controlling the flow of water from the hot water inlet port to the fixture outlet port and for controlling the flow of water from the hot water inlet port to the bypass port, wherein the flow control unit opens to permit a flow of water from the hot water inlet port to the bypass port based on an activation condition and wherein the flow control unit controls a flow of water from the hot water inlet port to the cold water port.

8. The water control fixture according to claim 7, wherein the activation condition is based on a temperature of the water within the flow control unit such that when the temperature is below a predetermined amount, water is permitted to flow from the hot water inlet port to the bypass port.

9. The water control fixture according to claim 7, wherein the flow control unit controls a flow of water from the cold water port to the fixture outlet port.

10. The water control fixture according to claim 7, further comprising a flow restriction member, wherein the flow control unit fluidly couples the hot water inlet port, the cold water port, and the fixture discharge port to perform a hot/cold mixing function, and wherein the flow control unit fluidly couples the hot water inlet port and both of the bypass port and the cold water port to perform a hot water recirculation function through at least one of the bypass port and the cold water port, wherein hot water recirculation flow occurs through the cold water port when the flow restriction member is used, and wherein hot water recirculation flow occurs through the bypass port when the flow restriction member is not used.

11. The water control fixture according to claim 7, further comprising an antiscald device in fluid communication with the bypass port, wherein the antiscald device shuts off flow from the fixture outlet port when the water pressure is above a predetermined amount.

12. The water control fixture according to claim 7, further comprising an antiscald device in fluid communication with the bypass port, wherein the antiscald device changes the flow from one of the hot water inlet port, the cold water port and the bypass port to change the mixture of the water dispensed from the fixture outlet port when the water temperature is above a predetermined amount.

13. The water control fixture according to claim 7, further comprising a pressure device in fluid communication with the bypass port, wherein the pressure device changes a mixture ratio of water from at least one of the hot water inlet port, the cold water port and the bypass port when a pressure of the water flowing through at least one of the hot water inlet port, the cold water port and the bypass port fluctuates.

14. The water control fixture according to claim 7, wherein the flow control unit includes a first operating valve having the main passage for controlling the flow of water from the hot water inlet port and the cold water port to the fixture outlet port, and wherein the flow control unit includes a bypass valve and having a bypass passage for permitting recirculating flow between the hot water inlet port and the bypass port.

15. The water control fixture according to claim 7, wherein the flow control unit is operable in a first set of positions that restrict water flow through the fixture outlet port and allow water flow between the bypass port and at least one of the hot water inlet port, the cold water port, and the fixture outlet port, and is operable in a second set of positions that allow water flow through the fixture outlet port and allow water flow between the bypass port and at least one of the hot water inlet port, the cold water port, and the fixture outlet port.

16. The water control fixture according to claim 15, wherein the flow control unit is operable in a third set of positions that allow water flow through the fixture outlet port and restrict water flow through the bypass port.

17. A water control fixture, comprising:

a housing having a chamber and a plurality of ports in fluid communication with the chamber, the plurality of ports defining a hot water inlet port, a bypass port, and a fixture outlet port, wherein water is dispensed via the fixture outlet port; and a flow control unit received within the chamber and in fluid communication with the plurality of ports for controlling the flow of water from the hot water inlet ort to the fixture outlet port and for controlling the flow of water from the hot water inlet port to the bypass port, wherein the flow control unit opens to permit a flow of water from the hot water inlet port to the bypass port based on an activation condition;

wherein the activation condition is based on a pressure of the water within the flow control unit such that when the pressure is above a predetermined amount, water is permitted to flow from the hot water inlet port to the bypass port.

18. The water control fixture according to claim 17, wherein the plurality of ports includes a cold water port configured to be in fluid communication with a cold water supply line, the water control fixture further comprising a pressure device in fluid communication with the bypass port, wherein the pressure device changes a mixture ratio of water from at least one of the hot water inlet port, a cold water port and the bypass port when a pressure of the water flowing through at least one of the hot water inlet port, the cold water port and the bypass port fluctuates.

19. The water control fixture according to claim 17, wherein the plurality of ports includes a cold water port configured to be in fluid communication with a cold water supply line, the flow control unit controlling a flow of water from the hot water inlet port to the cold water port.

* * * * *